US011330874B2

(12) United States Patent
Kyung

(10) Patent No.: US 11,330,874 B2
(45) Date of Patent: May 17, 2022

(54) CONNECTING APPARATUS FOR WATCH STRAP AND WATCH STRAP WITH THE SAME

(71) Applicant: Apposter Inc., Seoul (KR)

(72) Inventor: Sung Hyun Kyung, Seoul (KR)

(73) Assignee: Apposter Inc., Seoul (KR)

( * ) Notice: Subject to any disclaimer, the term of this patent is extended or adjusted under 35 U.S.C. 154(b) by 338 days.

(21) Appl. No.: 16/682,179

(22) Filed: Nov. 13, 2019

(65) Prior Publication Data

US 2021/0127800 A1 May 6, 2021

(30) Foreign Application Priority Data

Oct. 31, 2019 (KR) ..... 10-2019-0137471

(51) Int. Cl.
*A44C 5/14* (2006.01)
*G04B 37/14* (2006.01)

(52) U.S. Cl.
CPC ..... *A44C 5/14* (2013.01); *A44D 2200/10* (2013.01); *G04B 37/1486* (2013.01)

(58) Field of Classification Search
CPC .... A44C 5/14; G04B 37/1493; Y10T 24/4718
See application file for complete search history.

(56) References Cited

U.S. PATENT DOCUMENTS 2,870,511 A * 1/1959 Sand ..... A44C 5/14 24/265 B
5,483,505 A * 1/1996 Cartier ..... G04B 37/1493 368/282
9,314,071 B2 * 4/2016 Rivera ..... A44C 5/14

FOREIGN PATENT DOCUMENTS

JP 3049000 U 5/1998
KR 20-0482896 Y1 3/2017

OTHER PUBLICATIONS

An Office Action mailed by the Korean Intellectual Property Office dated Dec. 24, 2020, which corresponds to Korean Patent Application No. 10-2019-0137471 and is related to U.S. Appl. No. 16/682,179.

* cited by examiner

*Primary Examiner* — Corey N Skurdal
(74) *Attorney, Agent, or Firm* — Studebaker & Brackett PC

(57) ABSTRACT

Disclosed are a connecting apparatus for a watch strap that enables a user to simply replace a watch strap without a separation tool, and a watch strap with the connecting apparatus. The connecting apparatus connects a body of a watch and a watch strap, and includes at least: a tube having a first hole; a first pin inserted in and being able to protrude from a first end of the tube; a second pin inserted in and being able to protrude from a second end of the tube; a spring disposed between the first and second pins, providing elasticity to the first and second pins, in first and second directions, respectively; a protrusive member connected to the first pin and protruding through the first hole; and a slider connected to the protrusive member, moving the first pin in the second direction, and having a portion overlapping the first hole.

6 Claims, 8 Drawing Sheets

CONNECTING APPARATUS FOR WATCH STRAP AND WATCH STRAP WITH THE SAME

CROSS-REFERENCE TO RELATED APPLICATIONS

This application claims the priority of Korean Patent Application No. 10-2019-0137471 filed on Oct. 31, 2019, in the Korean Intellectual Property Office, the disclosure of which is incorporated herein by reference.

BACKGROUND

Field

The present disclosure relates to a connecting apparatus for a watch strap configured to connect the body of a watch and a watch strap, and a watch strap with the same.

Description of the Related Art

A watch strap is connected to the body of a watch using a connecting apparatus for a watch so that the watch is worn on a wrist.

Recently, the society is diversified and individualized, watch straps are increasing used for the purpose of fashion for decorating the external appearance in addition to the fundamental function for holding a watch around a wrist.

A watch strap is replaced with another watch strap, depending on the preference of a user or damage to the watch strap.

In the related art, a wristwatch having a watch strap isolation unit that separates a watch strap from the watch using a hook pin of a buckle has been disclosed (see Prior Art Document 1).

According to the wristwatch having a watch strap isolation unit disclosed in Patent Document 1, a watch strap connection pin 290 is compressed by a hook pin 510 and then the watch strap is separated from the watch.

Using an isolation unit such as the hook pin 510 causes a problem that separation work is inconvenient and the watch or the watch strap is scratched during the separation work.

Prior Art Document 1

Korean Utility Model No. 20-0482896 (Watch Having Isolation Unit to Isolate Band)

SUMMARY

In order to solve the problems described above, an object to be achieved by the present disclosure is to provide a connecting apparatus for a watch strap that enables a user to simply replace a watch strap without a specific separation tool, and a watch strap with the connecting apparatus.

The objects of the present disclosure are not limited to the objects described above and other objects will be clearly understood by those skilled in the art from the following description.

According to an aspect of the present disclosure, a connecting apparatus for a watch strap is configured to connect a body of a watch and a watch strap and includes: a tube having a first hole formed on an outer surface thereof; a first pin inserted in a first end of the tube and being able to protrude from the first end of the tube; a second pin inserted in a second end of the tube and being able to protrude from the second end of the tube; a spring disposed between the first pin and the second pin, providing elasticity to the first pin in a first direction, and providing elasticity to the second pin in a second direction that is an opposite direction to the first direction; a protrusive member connected to the first pin and protruding through the first hole; and a slider connected to the protrusive member, moving the first pin in the second direction, and having a portion overlapping the first hole.

The slider may be disposed in an area adjacent to the first hole.

The first pin may have: a first pin body being movable in the tube; and a first protrusion coupled to the first pin body and protruding from the first end of the tube.

The first hole may have a length corresponding to a length of the first protrusion.

The second pin may have: a second pin body being movable in the tube; and a second protrusion coupled to the second pin body and protruding from the second end of the tube.

The first hole may be formed to correspond to the shape of a second hole formed at the watch strap.

A size of the first hole may be smaller than a size of a second hole formed at the watch strap.

According to another aspect of the present disclosure, a watch strap is configured to be connected with a body of a watch and includes: a strap; an accommodation part formed in a hole shape passing through both sides of the strap; and a connecting apparatus for a watch strap configured to be accommodated in the accommodation part and connect the body of the watch and the watch strap, in which the connecting apparatus for a watch strap may include: a tube having a first hole formed on an outer surface thereof; a first pin inserted in a first end of the tube, protruding from the outer surface of the tube through the first hole, and being able to protrude from the first end of the tube; a second pin inserted in a second end of the tube and being able to protrude from the second end of the tube; a spring disposed between the first pin and the second pin, providing elasticity to the first pin in a first direction, and providing elasticity to the second pin in a second direction that is an opposite direction to the first direction; a protrusive member connected to the first pin and protruding through the first hole; and a slider connected to the protrusive member and moving the first pin in the second direction, in which a second hole may be formed at the strap in a shape corresponding to the first hole, and a portion of the slider may overlap the second hole.

An area adjacent to the first hole may be provided on the strap, and the slider may be disposed in the area adjacent to the first hole.

The strap may include: a first strap; and a second strap surrounding a first end of the first strap.

The accommodation part may be formed between the first end of the first strap and an inner surface of the second strap.

The second hole may be formed at the second strap.

According to an embodiment of the present disclosure, a user can separate the connecting apparatus for a watch strap from the body of a watch by moving the slider without using a specific separation tool, so convenience in replacement of a watch strap is improved.

Further, since a user can separate a watch strap from the body of a watch by moving the slider, it is convenient to replace and maintain a watch strap.

Further, since the first hole is not exposed from the first surface of the strap, the aesthetic appearance of a watch strap is improved.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENT

Figure 1:
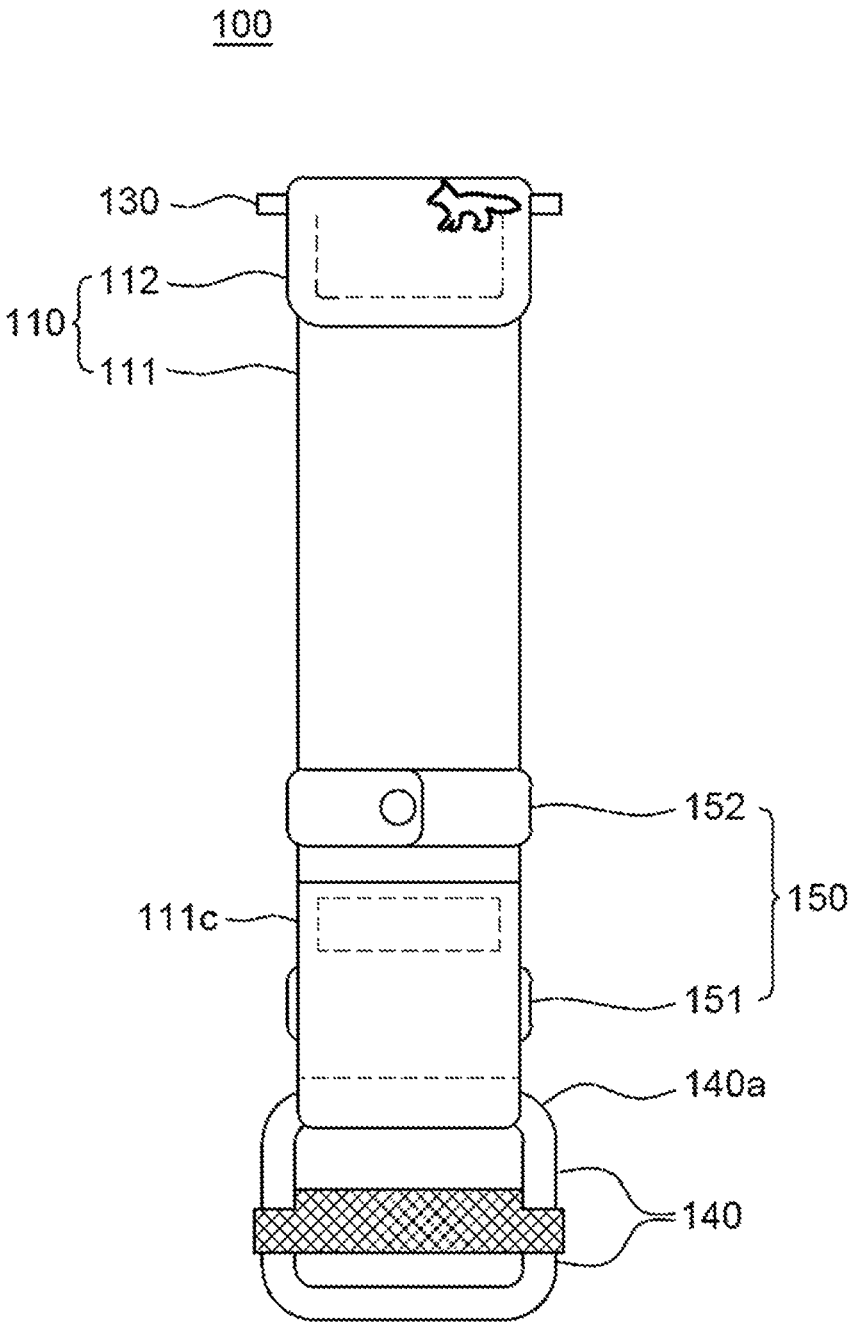
FIG. 1 is a plan view illustrating a watch strap with a connecting apparatus for a watch strap according to an embodiment of the present disclosure.

Various embodiments are described hereafter in detail with reference to the accompanying drawings. The embodiments described herein may be changed in various ways. Specific embodiments may be depicted in the drawings and described in detail in the following detailed description. However, the specific embodiments disclosed in the accompanying drawing are provided only to help easily understand various embodiments. Accordingly, the technical spirit of the present disclosure is not limited to the specific embodiments disclosed in the accompanying drawings and should be construed as including all equivalents or replacements included in the scope and spirit of the present disclosure.

Terms including ordinal numbers such as 'first', 'second', etc., may be used to describe various components, but the components are not to be construed as being limited to the terms. The terms are used only to distinguish one component from another component.

It will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof. It is to be understood that when one element is referred to as being "connected to" or "coupled to" another element, it may be connected directly to or coupled directly to another element or be connected to or coupled to another element, having the other element intervening therebetween. On the other hand, it is to be understood that when one element is referred to as being "connected directly to" or "coupled directly to" another element, it may be connected to or coupled to another element without the other element intervening therebetween.

In the meantime, "module" or "unit" for components used in the present specification performs at least one function or operation. Further, "module" or "unit" may perform functions or operations by hardware, software, or a combination of hardware and software. Further, a plurality of "modules" or a plurality of "units" excepting a "module" or a "unit" that should be executed by specific hardware or that is executed by at least one processor may be integrated at least one module. Singular forms are intended to include plural forms unless the context clearly indicates otherwise.

In addition, in describing the present disclosure, if it is determined that the detail description of relevant known functions or components makes subject matters of the present disclosure obscure, the detailed description thereof will be shortened or omitted.

Figure 2:
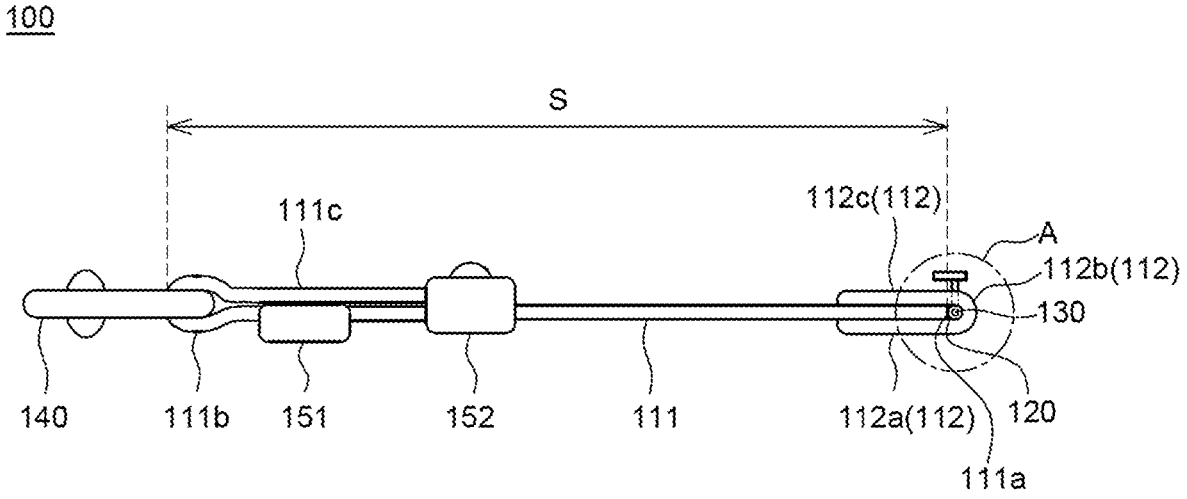
FIG. 2 is a side view illustrating the watch strap with a connecting apparatus for a watch strap according to an embodiment of the present disclosure.

FIG. 1 is a plan view illustrating a watch strap with a connecting apparatus for a watch strap according to an embodiment of the present invention and FIG. 2 is a side view illustrating the watch strap with a connecting apparatus for a watch strap according to an embodiment of the present invention.

Referring to FIGS. 1 and 2, a watch strap 100 according to an embodiment of the present invention includes a strap 110, an accommodation part 120 formed on the strap 110, and a connecting apparatus 130 for a watch strap that is accommodated in the accommodation part 120.

The strap 110 may be configured to come in contact with a portion of a wrist. The strap 110 may be provided in a shape that surrounds a portion of a wrist to be worn on the wrist.

The strap 110 may be made of at least one of materials such as leather, synthetic fabric, cotton fabric, hemp fabric, woolen fabric, silk fabric, staple fiber, or rayon fabric or combinations thereof, or may be made of various materials such as a metal material.

The strap 110 includes a first strap 111 and a second strap 112 surrounding a first end 111*a* of the first strap 111.

The first strap 111 can stretch and contract in the longitudinal direction S thereof.

A first end 112*a* of the second strap 112 is coupled to a first surface of the first strap 111 and a second end 112*c* of the second strap 112 is coupled to a second surface of the first strap 111.

The second strap 112 may be made of a material having strength higher than that of the first strap 111.

The second strap 112 may be coupled to the first surface and the second surface of the first strap 111 by sewing, but various other coupling methods using Velcro, a zipper, a snap, and a button may be used.

The second strap 112 has a bending portion 112*b* disposed between the first end 112*a* of the second strap 112 and the second end 112*c* of the second strap 112.

The bending portion 112*b* is provided in a bent shape and is spaced apart from the first end 111*a* of the first strap 111.

The accommodation part 120 may be provided in a hole shape passing through both sides of the strap 110. The accommodation part 120 is formed between the first end 111*a* of the first strap 111 and the bending portion 112*b* of the second strap 112.

The connecting apparatus for a watch strap 130 may protrude from both sides of the strap 110 while it is accommodated in the accommodation part 120. The connecting apparatus for a watch strap 130 will be described below with reference to the drawings.

The watch strap 100 may include a fastener 140 and a loop 150.

The fastener 140 can connect the watch strap 100 to another watch strap (not shown). The fastener 140 is coupled to the strap 110.

The strap 110 may have an extension 111*c* that extends from the second end 111*b* of the first strap 111. The extension 111*c* may surround a connecting portion 140*a* of the fastener 140. The extension 111*c* may be coupled to the second surface of the first strap 111 by sewing, but other various coupling methods using Velcro, a zipper, a snap, and a button may be used.

The loop 150 fixes another watch strap (not shown) with respect to the watch strap 100. The loop 150 may include a first loop 151 fixed between the first strap 111 and the extension 111*c*, and a second loop 152 moving along the first strap 111.

Figure 3:
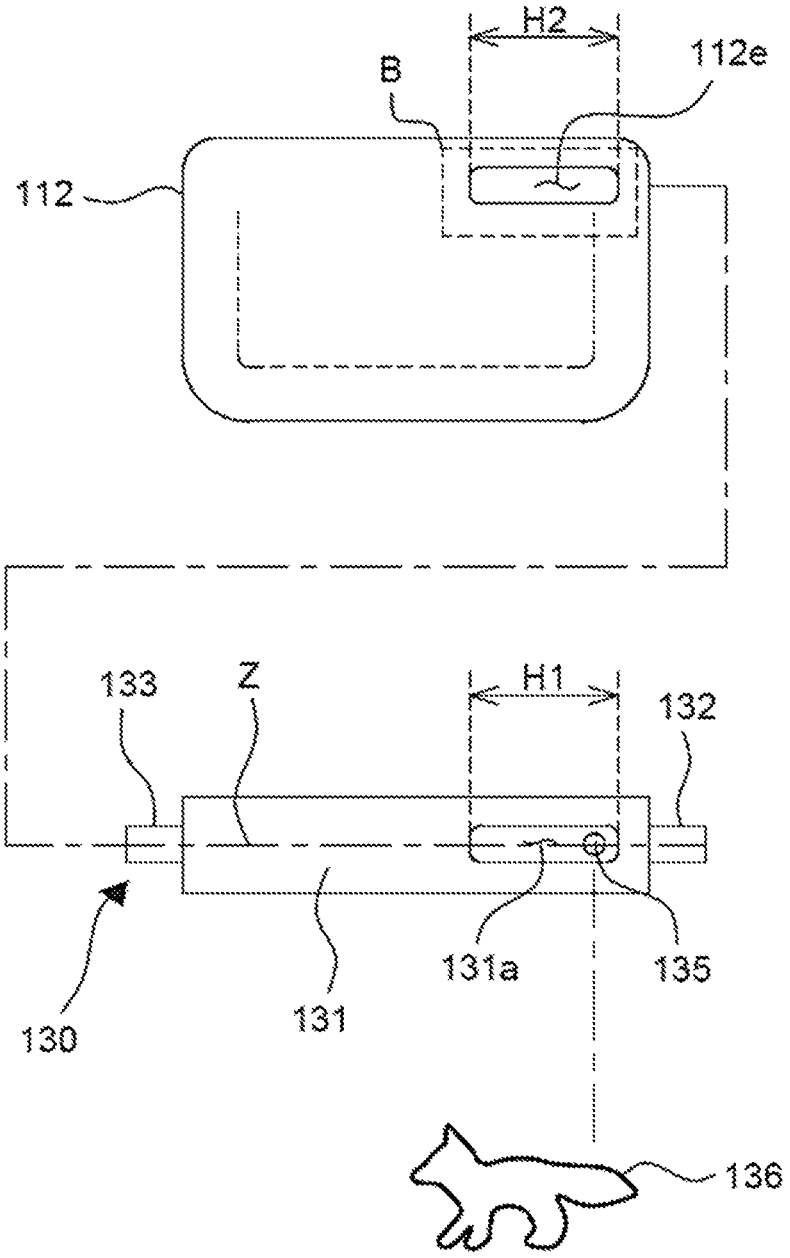
FIG. 3 is a view schematically illustrating the connecting apparatus for a watch strap shown in FIG. 1 and a strap.
Figure 4:
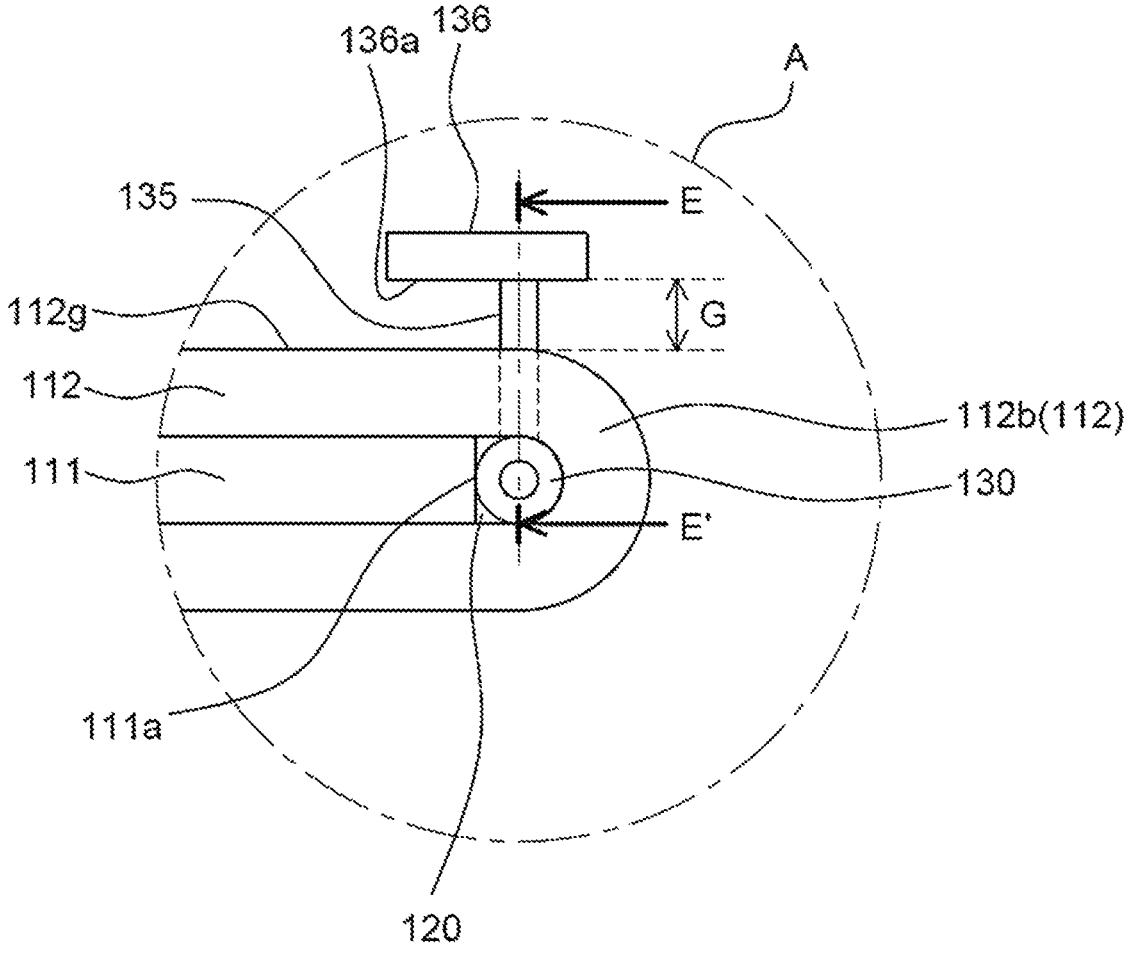
FIG. 4 is a view enlarging the portion A of FIG. 2.
Figure 5:
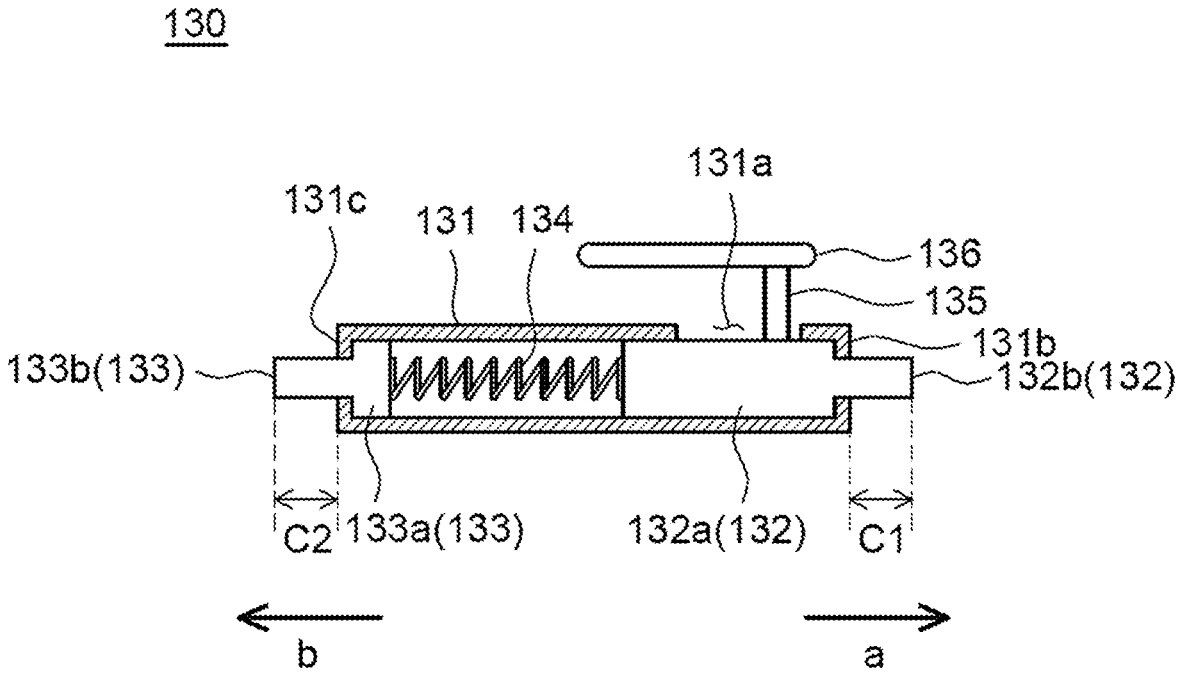
FIG. 5 is a cross-sectional view of the connecting apparatus for a watch strap taken along line E-E' of FIG. 4.

FIG. 3 is a view schematically illustrating the connecting apparatus for a watch strap shown in FIG. 1 and a strap, FIG. 4 is a view enlarging the portion A of FIG. 2, and FIG. 5 is a cross-sectional view take along line E-E' of FIG. 4.

Referring to FIGS. 3 to 5, the connecting apparatus 130 for a watch strap according to an embodiment of the present disclosure includes a tube 131, a first pin 132, a second pin 133, a spring 134, a protrusive member 135, and a slider 136.

The tube 131 may be provided in a cylindrical shape. A first hole 131*a* may be formed on the outer surface of the tube 131. The tube 131 may be made of a metal or plastic material, or may be made of various other materials having rigidity.

The first pin 132 may be inserted in a first end 131*b* of the tube 131. The first pin 132 may protrude from the first end 131*b* of the tube 131. The first pin 132 may be made of a metal or plastic material, or may be made of various other materials having rigidity.

The first pin 132 has a first pin body 132*a* and a first protrusion 132*b*.

The first pin body 132*a* can move in the tube 131.

The first protrusion 132*b* is coupled to the first pin body 132*a*. The first protrusion 132*b* protrudes from the first end 131*b* of the tube 131.

The second pin 133 may be inserted in a second end 131*c* of the tube 131. The second pin 133 may protrude from the second end 131*c* of the tube 131. The second pin 133 may be made of a metal or plastic material, or may be made of various other materials having rigidity.

The second pin 133 has a second pin body 133*a* and a second protrusion 133*b*.

The second pin body 133*a* can move in the tube 131.

The second protrusion 133*b* is coupled to the second pin body 133*a*. The second protrusion 133*b* protrudes from the second end 131*c* of the tube 131.

The length C2 of the second protrusion 133*b* may be the same as the length C1 of the first protrusion 132*b*.

The spring 134 is provided in the tube 131. The spring 134 is disposed between the first pin 132 and the second pin 133.

The spring 134 provides elasticity to the first pin 132 in a first direction 'a'. The first protrusion 132*b* of the first pin 132 protrudes from the first end 131*b* of the tube 131 in the first direction 'a'.

When external force larger than the elasticity of the spring 134 is applied to the first protrusion 132*b* of the first pin 132 in a second direction 'b' that is the opposite direction to the first direction 'a', the first pin 132 moves in the second direction 'b', and the first protrusion 132*b* of the first pin 132 is inserted in the tube 131, so the first protrusion 132*b* may not protrude from the first end 131*b* of the tube 131.

The spring 134 provides elasticity to the second pin 133 in the second direction 'b' that is the opposite direction to the first direction 'a'. The first protrusion 133*b* of the second pin 133 protrudes from the second end 131*c* of the tube 131 in the second direction 'b'.

When external force larger than the elasticity of the spring 134 is applied to the second protrusion 133*b* of the second pin 132 in the first direction 'a', the second pin 132 moves in the first direction 'a', and the second protrusion 133*b* of the second pin 133 is inserted in the tube 131, so the second protrusion 133*b* may not protrude from the second end 131*c* of the tube 131.

The protrusive member 135 is connected to the first pin 132. The protrusive member 135 may be coupled to the outer surface of the first pin 132 by welding, or may be coupled in various other methods such as thread-fastening.

The protrusive member 135 protrudes out of the tube 131 through the first hole 131*a*. The protrusive member 135 can be guided by the first hole 131*a* to move with the first pin 132 in the first direction 'a' or the second direction 'b'.

The slider 136 is connected to the protrusive member 135. The slider 136 may be coupled to the protrusive member 135 by welding, or may be coupled in various other methods such as thread-fastening.

An inner surface 136*a* of the slider 136 may be spaced a predetermined gap G apart from an outer surface 112*g* of the second strap 112. The slider 136 is moved by external force not in contact with the second strap 112, so damage due to contact of the slider 136 and the second strap 112 is prevented.

When external force larger than the elasticity of the spring 134 is applied to the slider 136 in the second direction 'b', the slider 136 moves in the second direction 'b'. The slider 136 moves in the second direction 'b' together with the protrusive member 135 connected with the slider 136. The protrusive member 135 moves in the second direction 'b' together with the first pin 132 connected with the protrusive member 135. The slider 136 can move the first pin 132 in the second direction 'b'.

The protrusive member 135 can move with the first pin 132 in the first direction 'a' or the second direction 'b' within the range of the length H1 of the first hole 131*a*.

Since the slider 136 is connected to the protrusive member 135, the slider 136 can also move with the first pin 132 in the first direction 'a' or the second direction 'b' within the range of the length H1 of the first hole 131*a*.

The length H1 of the first hole 131*a* may be the length C1 of the first protrusion 132*b*. When the slider 136 moves by the length H1 of the first hole 131*a*, the first protrusion 132*b* having the length C1 corresponding to the length H1 of the first hole 131*a* is inserted into the tube 131, so the first protrusion 132*b* does not protrude from the first end 131*b* of the tube 131.

Accordingly, the length of the first hole 131*a* is minimized, whereby damage to the joint between the slider 136 and the protrusive member 135 and the joint between the protrusive member 135 and the first pin 132 due to excessive movement of the slider 136 is prevented.

A portion of the slider 136 may overlap the first hole 131*a*. Accordingly, the first hole 131*a* is prevented from being exposed from a first surface of the second strap 112.

The slider 136 may be disposed in an area B adjacent to the first hole 131*a*.

The slider 136 may be provided in an animal shape, and may be provided in various other shapes as long as the slider 136 can cover the first hole 131*a*.

A second hole 112*e* may be formed at the second strap 112. The second hole 112*e* may be formed to correspond to the shape of the first hole 131*a*. The protrusive member 135 protrudes out of the second strap 112 through the second hole 112*e* and moves in the first direction 'a' or the second direction 'b'. As the second hole 112*e* is formed to correspond to the shape of the first hole 131*a*, damage to the second strap 112 due to contact between the protrusive member 135 and the second strap 112 when the protrusive member 135 is moved through the second hole 112*e* is prevented.

A portion of the slider 136 may overlap the second hole 112*e*. Accordingly, the second hole 112*e* is prevented from being exposed from the first surface of the second strap 112.

The size of the first hole 131*a* may be smaller than the second hole 112*e*. When the size of the first hole 131*a* may be smaller than the second hole 112*e*, damage to the second strap 112 due to contact between the protrusive member 135 and the second strap 112 in which the second hole 112*e* is formed when the protrusive member 135 is guided to move by the first hole 131*a* is prevented.

Figure 6:
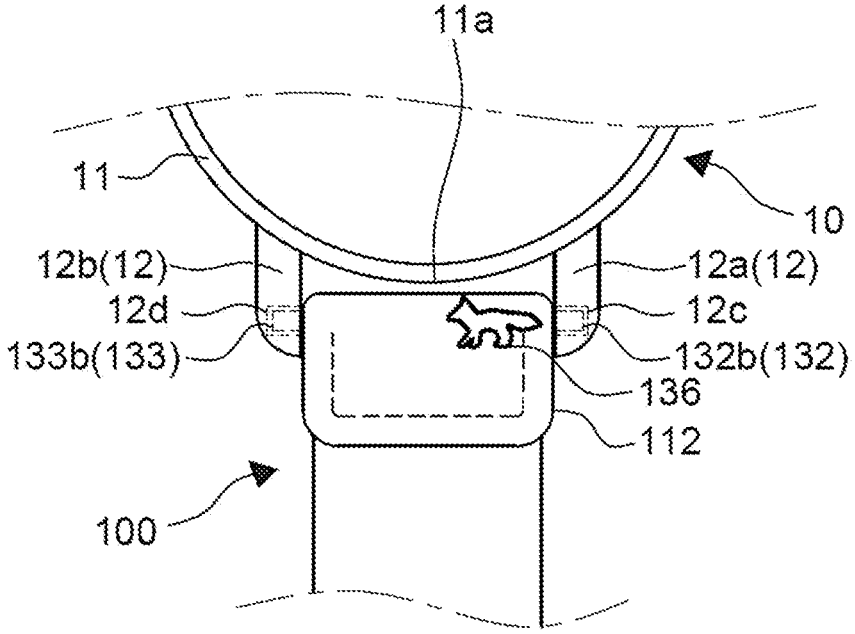
FIG. 6 is a view schematically illustrating a watch according to an embodiment of the present disclosure.
Figure 7:
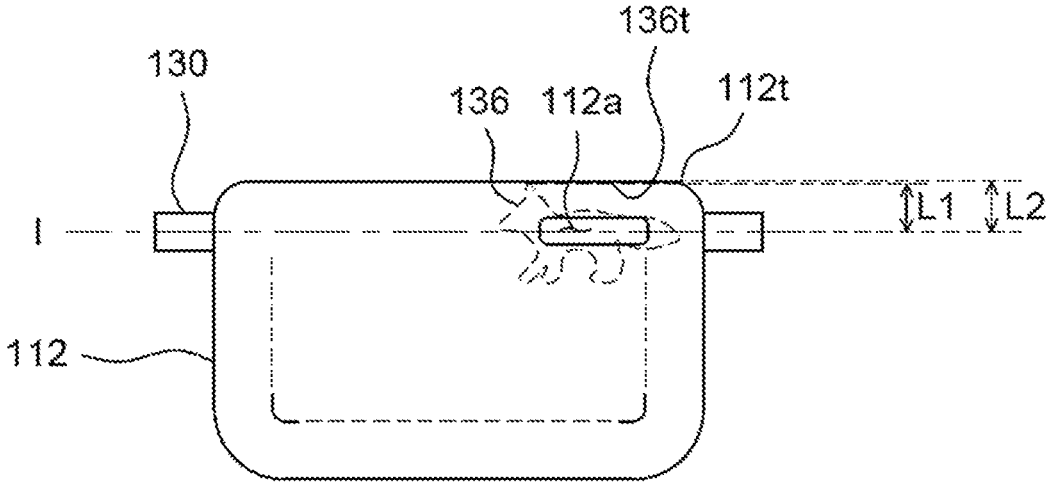
FIG. 7 is a view schematically illustrating the state when the connecting apparatus for a watch strap shown in FIG. 3 and a strap have been combined.

FIG. 6 is a view schematically illustrating a watch according to an embodiment of the present disclosure and FIG. 7 is a view schematically illustrating the state when the connecting apparatus for a watch strap shown in FIG. 3 and a strap have been combined.

Referring to FIGS. 6 and 7, a watch 10 according to an embodiment of the present disclosure includes a watch body 11, the watch strap 100, and a plurality of lugs 12 connecting the watch body 11 and the watch strap 100. The watch 10 may be an analog watch or a digital watch such as a smartwatch.

The above description is referred to for the description of components that are the same as or similar to the components described above.

The watch body 11 may include an hour hand and a minute hand that point time, and may further include a display that displays time or date.

The plurality of lugs 12 extends from the watch body 11 and can support the connecting apparatus 130 for a watch strap such that the connecting apparatus 130 can rotate. The plurality of lugs 12 includes a first lug 12*a* and a second lug 12*b*.

A first groove 12*c* in which the first pin 132 is inserted is formed on the first lug 12*a*. A second groove 12*d* in which the second pin 133 is inserted is formed on the second lug 12*b*. The connecting apparatus 130 for a watch strap is rotatably coupled by the plurality of lugs 12 with the first pin 132 inserted in the first groove 12*c* and the second pin 133 inserted in the second groove 12*d*.

The slider 136 is disposed on the second strap 112. A maximum length L1 between a virtual line I, which passes through a first surface of the slider 136 and is positioned at a shortest distance from the central axis Z (see FIG. 3) of the tube, and an edge 136*t* of the slider 136 may be equal to or shorter than a distance L2 between the central axis Z of the tube and an edge 112*t* of the second strap 112. The virtual line I is the same as the central axis Z (see FIG. 3) of the tube in FIG. 7.

The slider 136 is disposed not in contact with an edge 11*a* of the watch body 11.

Figure 8A:
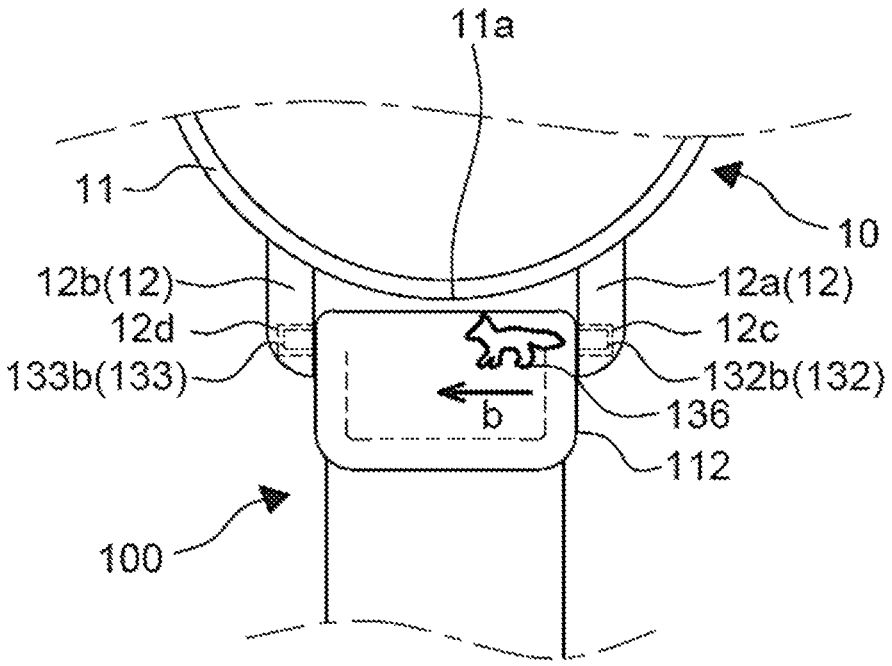
FIGS. 8A to 8C are views showing a process in which the watch strap according to an embodiment of the present disclosure is separated from the body of a watch.
Figure 8B:
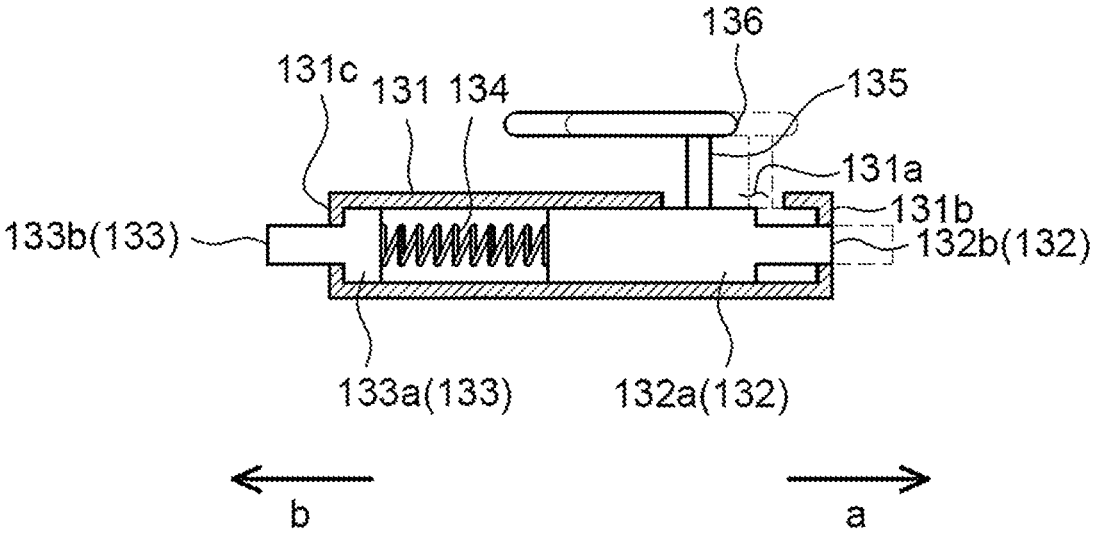
Figure 8C:
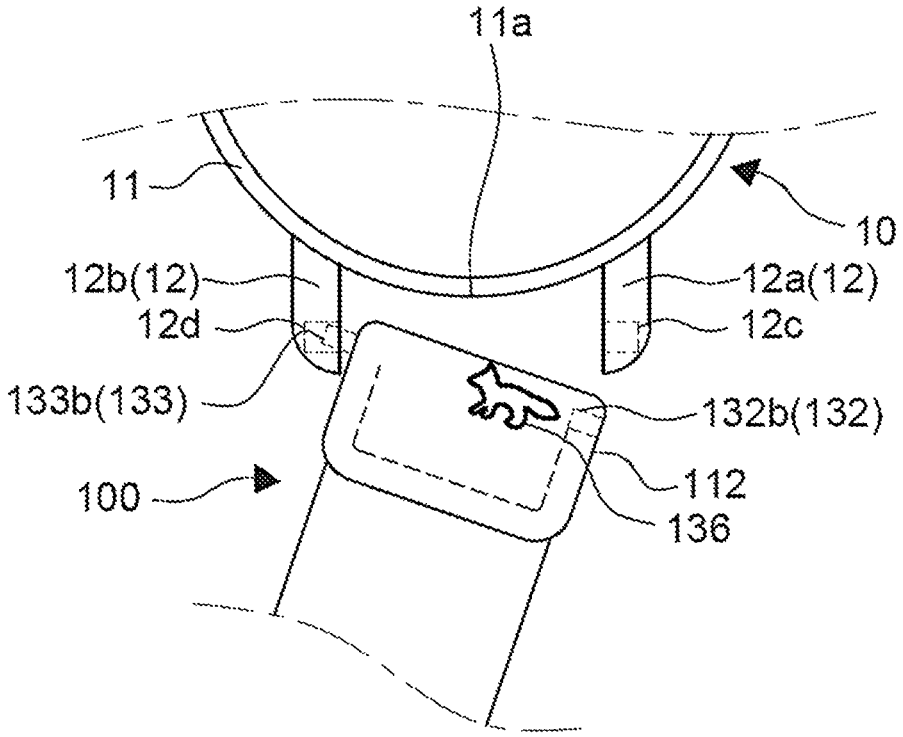

FIGS. 8A to 8C are views showing a process in which the watch strap according to an embodiment of the present disclosure is separated from the body of a watch.

A process in which the watch strap 100 according to an embodiment of the present disclosure is separated from the watch body 11 is described with reference to FIGS. 8A to 8C.

When external force is applied to the slider 136 in the second direction 'b' by a user, the slider 136 moves in the second direction 'b' together with the first pin 132.

As the first pin 132 moves in the second direction 'b', the first protrusion 132*b* of the first pin 132 is inserted into the tube 131 and separated from the first groove 12*c*.

As shown in FIG. 8C, when the watch strap 100 is pulled at an angle with respect to the second direction 'b' by a user with the slider 136 moved in the second direction 'b', the first pin 132 is separated out of the plurality of lugs 12.

When the watch strap 100 is pulled at an angle with respect to the first direction 'a' by a hand of a user, the second pin 133 is also separated from the second groove 12*d*.

The watch strap 100 is separated from the watch body 11 and can be replaced with another watch strap.

Although exemplary embodiments of the present disclosure were illustrated and described above, the present disclosure is not limited to the specific exemplary embodiments and may be modified in various ways by those skilled in the art without departing from the scope of the present disclosure described in claims, and the modified examples should not be construed independently from the spirit of the scope of the present disclosure.

What is claimed is:

1. A watch strap including:

a strap;

a connecting apparatus for a watch strap that is configured to connect a body of a watch and a watch strap, wherein the connecting apparatus includes:

a tube having a first hole formed on an outer surface thereof;

a first pin inserted in a first end of the tube and being able to protrude from the first end of the tube;

a second pin inserted in a second end of the tube and being able to protrude from the second end of the tube;

a spring disposed between the first pin and the second pin, providing elasticity to the first pin in a first direction, and providing elasticity to the second pin in a second direction that is an opposite direction to the first direction;

a protrusive member fastened to both ends of the first pin; and a slider connected to the protrusive member, moving the first pin in the second direction, and having a portion overlapping the first hole, wherein the strap includes:

a first strap;

a second strap surrounding a first end of the first strap and including a bending portion that is spaced apart from the first end of the first strap and a second hole that is formed to correspond to a shape of the first hole; and an accommodation part formed between the first end of the first strap and the bending portion, and wherein the tube of the connecting apparatus for the watch strap is configured to be accommodated in the accommodation part, and the protrusive member passes through the first hole and the second hole and protrudes to an outside of the second strap while the tube of the connecting apparatus for the watch strap is accommodated in the accommodation part.

2. The watch strap of claim 1, wherein the slider is disposed in an area adjacent to the first hole.

3. The watch strap of claim 1, wherein the first pin has:

a first pin body being movable in the tube; and a first protrusion coupled to the first pin body and protruding from the first end of the tube.

4. The watch strap of claim 3, wherein the first hole has a length corresponding to a length of the first protrusion.

5. The watch strap of claim 3, wherein the second pin has:

a second pin body being movable in the tube; and a second protrusion coupled to the second pin body and protruding from the second end of the tube.

6. The watch strap of claim 1, wherein a size of the first hole is smaller than a size of the second hole.

* * * * *